US007267335B2

(12) United States Patent
Kubo

(10) Patent No.: US 7,267,335 B2
(45) Date of Patent: Sep. 11, 2007

(54) METHOD OF CONTROLLING SHEET FEEDER APPARATUS

(75) Inventor: Eiichi Kubo, Nishiyatsushiro-gun (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 11/177,346

(22) Filed: Jul. 11, 2005

(65) Prior Publication Data

US 2005/0248078 A1 Nov. 10, 2005

Related U.S. Application Data

(63) Continuation of application No. 10/270,357, filed on Oct. 15, 2002, now abandoned.

(30) Foreign Application Priority Data

Oct. 15, 2001 (JP) ..... 2001-317228

(51) Int. Cl.
*B65H 1/08* (2006.01)

(52) U.S. Cl. ..... 271/127; 271/126; 270/58.09

(58) Field of Classification Search ..... 271/126, 271/127; 270/58.09

See application file for complete search history.

(56) References Cited

U.S. PATENT DOCUMENTS 3,955,811 A * 5/1976 Gibson ..... 271/9.05
5,009,410 A * 4/1991 Fujii et al. ..... 271/127
5,678,814 A * 10/1997 Yokoyama et al. ..... 271/9.05

* cited by examiner

*Primary Examiner*—Gene O. Crawford
*Assistant Examiner*—Leslie A Nicholson, III
(74) *Attorney, Agent, or Firm*—Manabu Kanesaka

(57) ABSTRACT

A sheet feeder apparatus is controlled for sequentially feeding sheets to a predetermined processing position. A detection signal of a sheet stacked in a rise and lower tray located at a lower limit position is received before receiving a feed signal to start feeding of the sheet. Upon receiving the feed signal to start feeding of the sheet, the rise and lower tray is moved from the lower limit position to an upper limit position, and the sheet is supplied.

1 Claim, 12 Drawing Sheets

METHOD OF CONTROLLING SHEET FEEDER APPARATUS

CROSS-REFERENCE TO RELATED APPLICATION

This is a continuation application of Ser. No. 10/270,357 filed on Oct. 15, 2002, now abandined.

BACKGROUND OF THE INVENTION

The present invention relates to a method of controlling a feeder apparatus that supplies sheets loaded in a feed tray one at a time to a predetermined processing position, and in particular to a feeder apparatus equipped with a rise and lower tray that can rise and fall upward and downward so that the sheets on the feed tray can make contact with a supply means to be supplied.

RELATED ART STATEMENT

It is desirable that a feeder apparatus used in copying machines, facsimiles, printers and document feeding apparatuses can handle a greater number of sheets at one time as possible.

A feed tray where the sheets are loaded in an ADF that handles this type of thick bundle of sheets becomes deeper. However, in an ADF comprised such that the sheets are sequentially supplied from the uppermost position one sheet at a time, a supply position of the sheets will vary largely between when there is one sheet and when there are 100 sheets loaded on the feed tray, thereby creating a large gap to a feed path located at a fixed position. Thus, it is hindered to supply the sheet smoothly, thereby increasing a risk of paper jams.

Consequently, in order to reduce an influence of the number of the sheets loaded in a feed tray, there have been utilized conventional feeder apparatuses equipped with rise and lower trays that can rise and fall upward and downward for allowing a position of the sheet bundle to rise and fall in response to the position of a surface of the uppermost sheet. As an example of this type of conventional technology, Japanese Patent Publication (Tokkai) No. 09-166831 disclosed an apparatus that elevates a sheet lifting member for supplying the sheets held in holding means one by one when the sheet feed starts, and then allows the sheet lifting member to lower when the trailing edge of the last sheet in the holding means passes through the sending means.

In this conventional technology, when the feed command is received by pressing the read start button (start button) located on a side of a main image reading apparatus, the apparatus is controlled such that a support plate is raised from the lower limit position up to a position (upper limit position) where the uppermost sheet loaded on the feed tray reaches the supply position to contact a supply roller based on a sheet detection signal that a sheet sensor (hereinafter referred to as an empty sensor) detects the sheets loaded on the feed tray.

The support plate is controlled to rise in response to a reduction in an amount of the sheets supplied from the feed tray so that the supply roller always contacts the uppermost sheet, and to lower to the lower limit position located as an initial standby position when the empty sensor detects that all the sheets on the feed tray have been supplied.

In a feeder apparatus having the support plate controlled in this manner, there is little problem when a large number of document sheets are loaded on the feed tray (thick bundle of the sheets). However, when the number of the sheets is small, the support plate must move upward a long distance from a location close to the lower limit position up to the upper limit position at the highest position. Therefore, it takes a long time for the support plate to move to the position where the uppermost sheet is supplied after an operator presses the read start button (start button). In this case, the operator might suspect something wrong since the sheet feed does not start after the operator pressed the start button, and practically, the sheet read time requires a long time when the number of the sheets is small.

OBJECTS OF THE INVENTION

To solve the problems related to the conventional technology, the first object of the invention is to provide a method of controlling a feeder apparatus that can greatly shorten time to supply the uppermost sheet regardless of the amount of the sheets loaded on the feed tray.

The second object is to provide a method of controlling a feeder apparatus that can reduce the time to supply the uppermost sheet after receiving a feed signal as well as a feeder apparatus that can easily remove the loaded sheets all at once.

SUMMARY OF THE INVENTION

A feeder apparatus is equipped with stacking means for supporting an edge of a sheet on a feed tray and being able to rise and fall between a lower limit position for loading the sheets onto the feed tray and an upper limit position for allowing a top surface of the sheets to contact supplying means.

When an empty sensor S1 detects the sheet before a feed signal is received to start sheet feeding, the stacking means is controlled to rise to a predetermined sheet supply position in advance, and the sheet is supplied when the feed signal is received, thereby taking shorter time to supply the uppermost sheet after receiving the feed signal.

In addition, when the sheet is detected on the stacking means before a feed signal is received to start sheet feeding, the stacking means is controlled to rise to a standby position in advance, and to move from the standby position to a predetermined sheet supply position where the sheet is supplied when the feed signal is received, thereby taking shorter time to supply the uppermost sheet after receiving the feed signal. It is also easy to remove the loaded sheets all at once.

DETAILED DESCRIPTION OF PREFERRED EMBODIMENTS

Embodiments of the feeder apparatus related to the present invention will be described in detail based on an automatic document feeding apparatus whereon the feeder apparatus of the present invention is applied.

Figure 1:
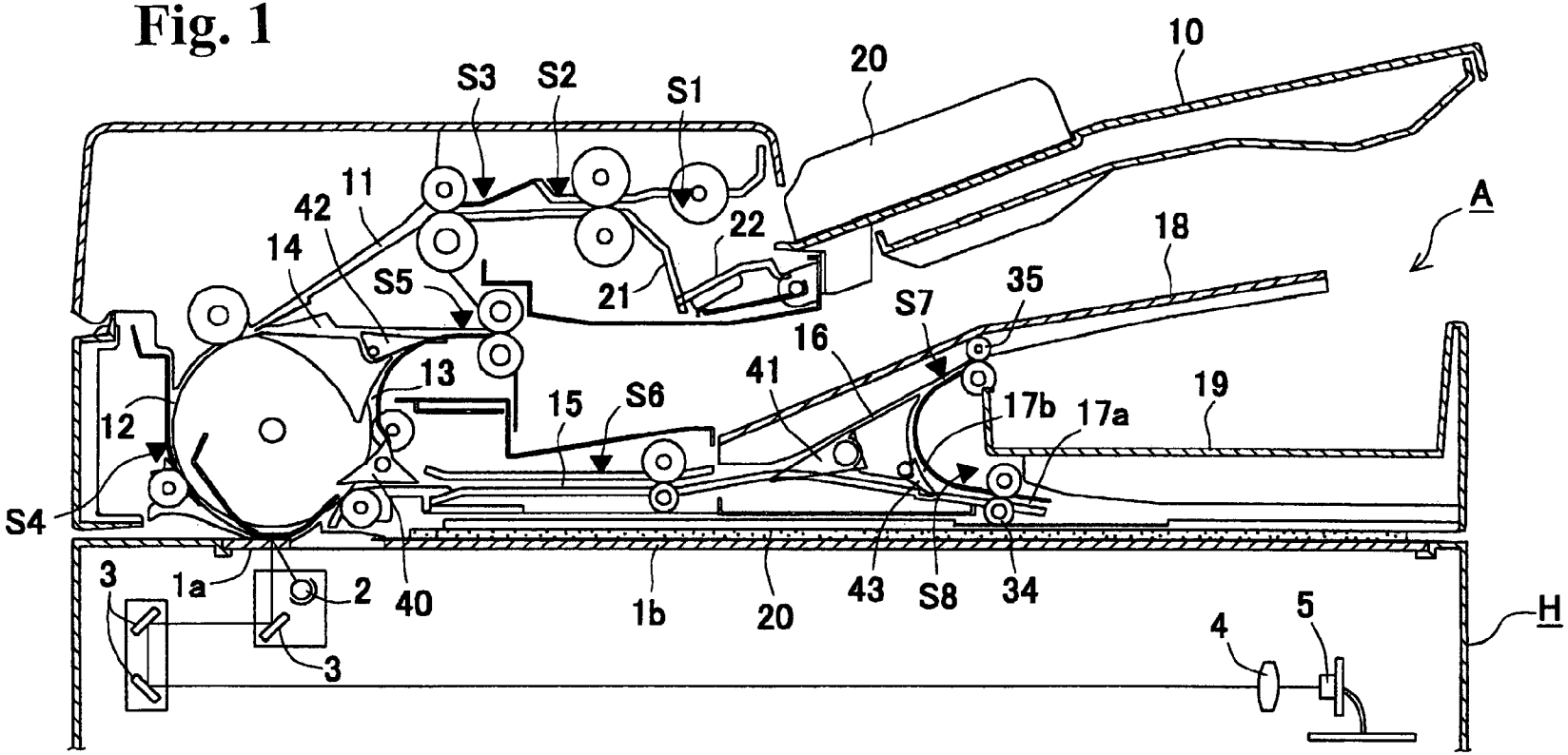
FIG. 1 is a view showing an entire configuration of an automatic document feeding apparatus to which a feeder apparatus of the present invention is applied.
Figure 2:
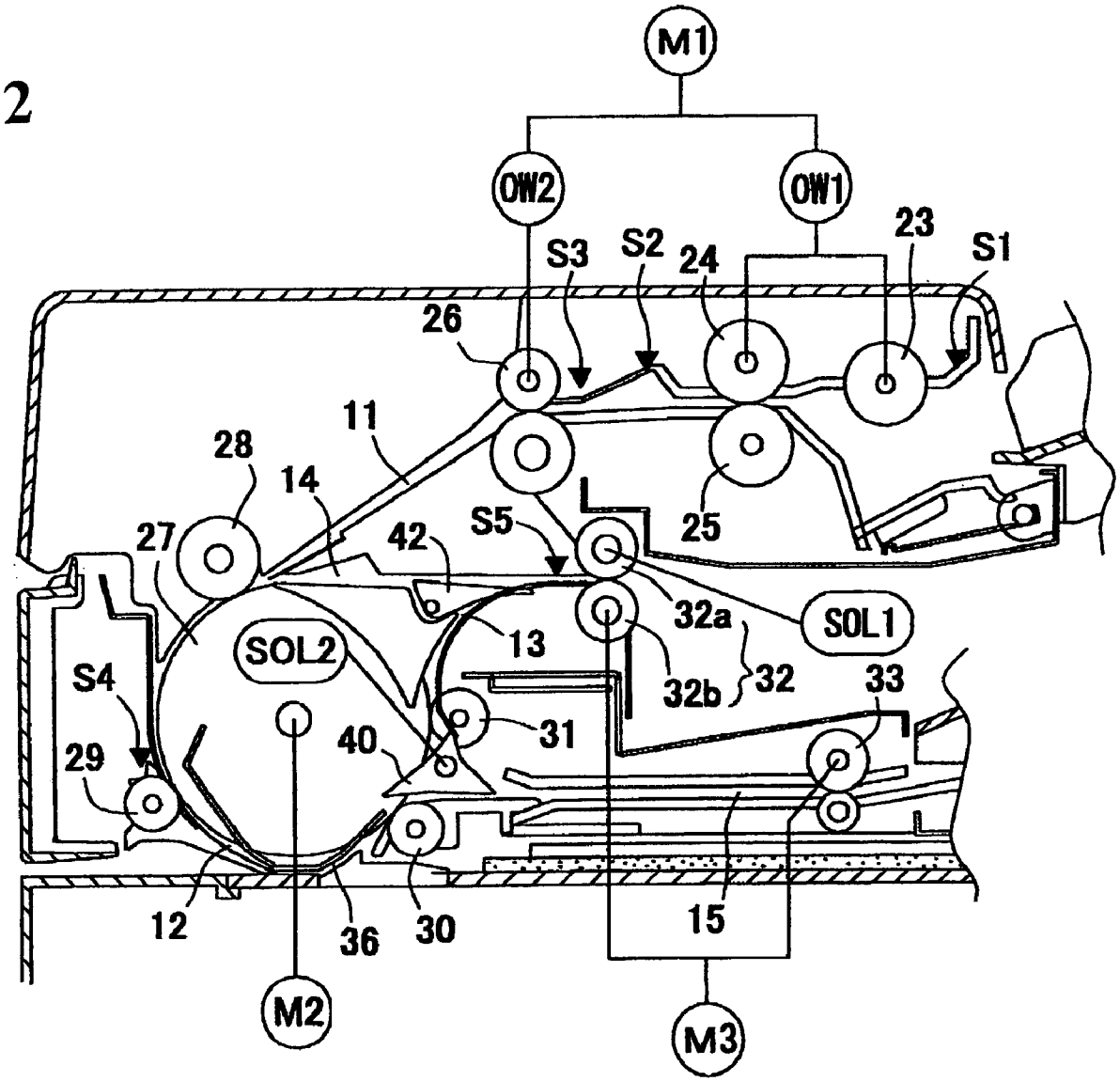
FIG. 2 is a view showing main components of the automatic document feeding apparatus to which the feeder apparatus of the present invention is applied.

FIG. 1 shows the overall composition of an automatic document feeding apparatus equipped with a feeder apparatus installed on the image reading apparatus. FIG. 2 is an expanded view of the principal components of the automatic document feeding apparatus.

Looking at FIG. 1, A is the automatic document feeding apparatus installed on the image reading apparatus H. The automatic document feeding apparatus A transports documents in a manner such that they pass over the contact glass surface 1*a* of the main unit H.

The main unit H reads document images by illuminating the document that is transported by a light from the light source 2, such as a lamp, through the first contact glass 1*a*, reflecting this reflected light by the mirror 3 and then photoelectrically converting the light using the reading means 5 (such as a CCD) through the lens 4. Consequently, the upper surface of the first contact glass 1*a* comprises the reading components of the main unit H. The main unit H is also equipped with the second contact glass 1*b* that has a surface area onto which documents can be loaded. The main unit H can read images of documents through the second contact glass 1*b* by means of opening and closing the automatic document feeding apparatus A and moving a light source unit, formed from the light source 2 or mirror 3, in a vertical scanning direction over thick documents, such a books, loaded onto the contact glass 1*b*.

Next, the composition of the automatic document feeding apparatus A will be described referring to FIG. 1 and FIG. 2.

The automatic document feeding apparatus A comprises the feed tray 10 that functions as a stacking means whereon a plurality of documents can be loaded, the support plate 22 that loads a plurality of documents and rises upward and falls downward to a supply position, and the first delivery tray 18 and second delivery tray 19 which function as a storage means to store the read documents. The first delivery tray 18 mainly stores large-sized documents and the second delivery tray 19 stores small-sized documents. The descriptive number 20 in FIG. 1 is a push-up lever comprised by a porous member, such as a sponge, and a film member, such as white Mylar. This push-up lever 20 functions to push the second contact glass 1*b* upward.

In addition, the automatic document feeding apparatus A has the feed path 11 that feeds documents located on the feed tray towards the second contact glass 1*b* one by one, the transport path 12, formed coupled to the feed path 11, that guides documents along the upper surface of the first contact glass 1*a*, and the first delivery path 13 coupled from the transport path 12 to the delivery opening of the first delivery tray 18. The automatic document feeding apparatus A also has the circulation path 14 connected from the delivery opening of the first delivery tray 18 to the connecting portion between the feed path 11 and the transport path 12 that returns documents to the transport path 12, the middle path 15, formed branching off from the first delivery path 13, that guides documents from the transport path 12, and the second delivery path 16 coupled from the middle path 15 to the delivery opening of the second delivery tray 19. The document path is comprised of the switchback path 17*a*, formed branching off from the second delivery path 16, that allows documents to switch back from the middle path 15 and the reverse path 17*b* that reverses the front and back sides of the documents which were switched back and guides them to the delivery opening of the second delivery tray 19.

The sides of the documents loaded on the feed tray 10 are controlled by the side guard 20 and the edges of the documents are further controlled by the stopper barrier 21. The feed tray 10 is mounted so it can rotate with the side of the document in the direction of the feed acting as a fulcrum.

Various devices are arranged on the feed path 11; the supply roller 23 that supplies documents, the rise and lower tray (hereinafter referred to as the support plate 22) that raises the edge of the documents loaded on the feed tray 10 for allowing it to make contact with the supply roller 23, the rise and fall lever 49 that raises and lowers the support plate 22, the separation means comprising the feed roller 24 that feeds documents supplied by the supply roller 23 and the separation member 25 that only allows the first document at the highest position to pass and hinders the feed of the documents after the second sheet, and the pair of resistance rollers 26 which sends documents to the lower flow level in the apparatus after the edges of the documents which are separated into individual sheets by the separation means and fed, are straightened out.

The supply roller 23 and the feed roller 24 are coupled to and driven by the feed motor M1 through the one-way clutch OW1. The pair of resistance rollers 26 is also coupled to and driven by the feed motor M1 through the one-way clutch OW2. This linkage drives the supply roller 23 and the feed roller 24 by the forward turning of the feed motor M1. The pair of resistance rollers 26 is driven by the reverse turning of the motor. The plurality of driven rollers 28, 29 and 30 is arranged in the transport path 12. These driven rollers 28, 29 and 30 press against the large diameter transport roller 27 and the peripheral surface of the transport roller 27. The transport roller 27 is comprised so as to be driven by the transport motor M2.

The driven roller 31 and the pair of first delivery rollers 32 are arranged in the first delivery path 13. The driven roller 31 presses against the transport roller 27 and the pair of first delivery rollers 32 delivers documents to the first delivery tray 18. The pair of first delivery rollers 32 is coupled to the first reverse delivery motor M3 that can rotate forward and reverse. They are controlled such that the back edge of the document turns in reverse in a nipped state in double-side mode, the document switches back and then is sent to the transport path 12 through the circulation path 14. In addition, the pair of first delivery rollers 32 is comprised such that one of the rollers 32*a* separates from the other roller 32*b* by means of the pressure solenoid SOL1 that allows document transport without any impediments when the leading edges of the documents are shifting differently as they circulate through the circulation path 14 and the transport path 12.

The pair of middle rollers 33 is arranged in the middle path 15. This pair of middle rollers 33 sends documents to the lower flow level. The pair of second delivery rollers 35 is arranged in the second delivery path 16. The pair of second delivery rollers 35 delivers documents to the second delivery tray 19. Furthermore, the pair of switchback rollers 34 is arranged in the switchback path 17*a*. The pair of switchback rollers 34 allows documents to switchback and then sends the documents to the pair of second delivery rollers 35 through the reverse path 17*b*.

The pair of middle rollers 33 is driven by the first reverse delivery motor M3, and the pair of second delivery rollers 35 and the pair of switchback rollers 34 are driven by the second reverse delivery motor M4 that can turn forward and reverse.

The first flapper 40 is disposed in the lower flow side of the transport path 12 and functions to guide documents to either the first delivery path 13 or the middle path 15. The second flapper 41 is also disposed in the lower flow side of the middle path 15 and functions to guide documents to either the second delivery path 16 or the switchback path 17*a*. These two first and second flappers are movable by means of the first solenoid SOL2 and the second solenoid SOL3, respectively. The empty weight flappers 42, 43 are disposed in the first delivery path 13 and the switchback path 17*a*. These flappers 42, 43 are movable in the upward direction by means of the leading edges of the documents which are sent and allow the documents to pass through. When the trailing edges of the documents pass through the flippers, they are movable in the downward direction.

The empty sensor S1 is disposed in the document feed direction lower flow side of the feed tray 10. This sensor detects whether documents are loaded on the feed tray 10. The length sensor S2 and the resistance sensor S3 are disposed on the feed path 11. These sensors detect the edges of the documents being fed. The lead sensor S4 is disposed in front of the first contact glass 1*a*. The first discharge sensor S5 is disposed at the delivery opening of the delivery tray 18. The center sensor S6 is disposed in the middle path 15. The second delivery sensor S7 is disposed close to the delivery opening of the second feed tray 19. The switchback sensor S8 is disposed in the switchback path 17*a*. These sensors detect the edges of the documents being sent. The upper limit sensor S9 and the lower limit sensor S10 are disposed close to the feed opening of the feed path 11. The upper limit sensor S9 detects whether the support plate 22 is located at the upper limit position where the document surface at the highest position makes contact with the supply roller 23. The lower limit sensor S10 detects whether the support plate is located at the lower limit position where the document can be loaded.

Figure 3:
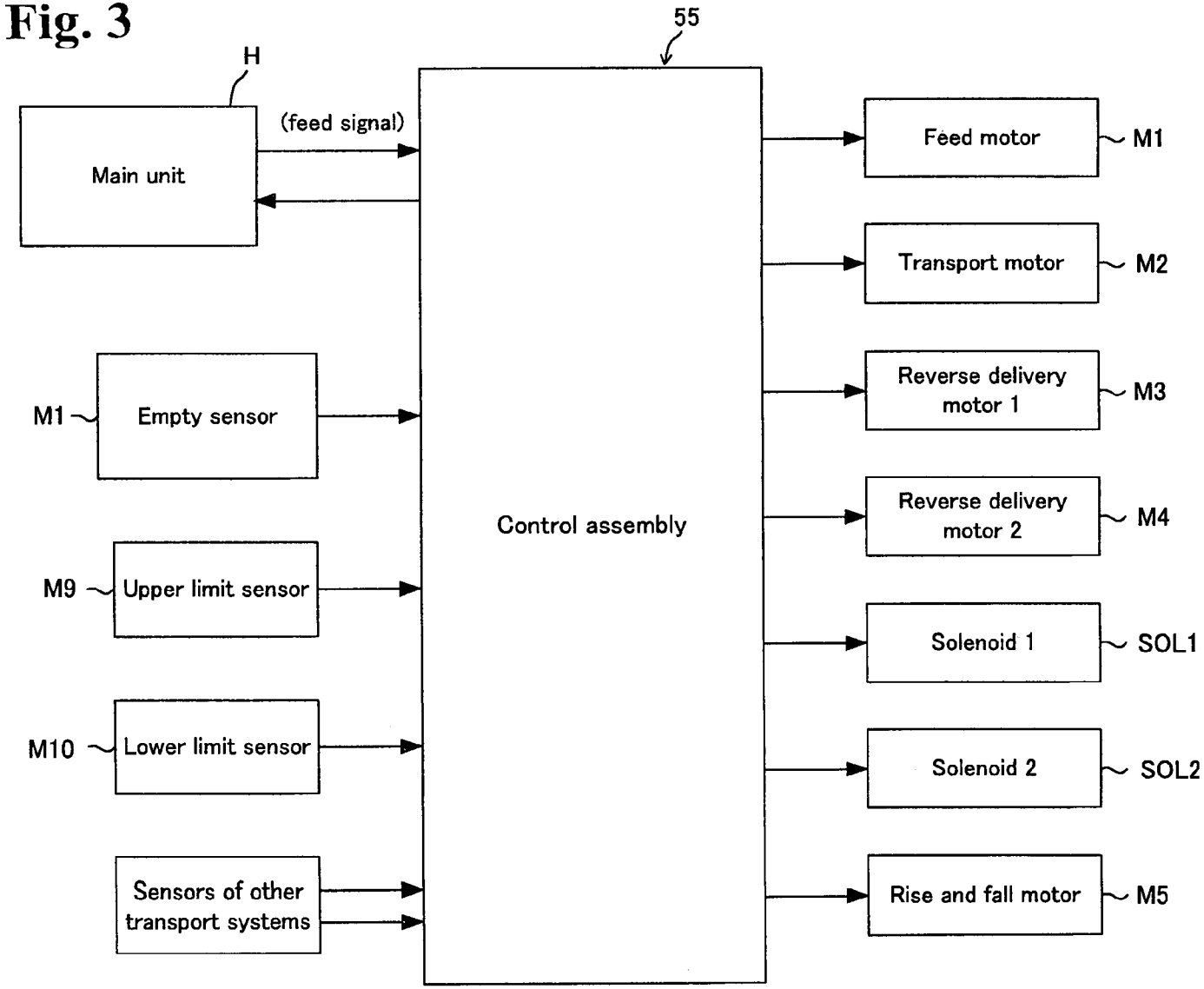
FIG. 3 is a control block diagram according to the present invention.

As shown in FIG. 3, the above-mentioned sensors S1 to S10 are connected to the control assembly 55 that functions as a control means and contains a CPU. The control assembly 55 controls the transport of the documents. Each of the above-mentioned motors M1, M2, M3, M4 and each solenoid SOL1, SOL2 and SOL3 are controlled based on output signals from each sensor and then a send operation of documents is executed.

The control assembly 55 that functions as a control means (described later) controls the rise and fall motor MS based on output signals from the empty sensor S1, the upper limit detection sensor S9 and the lower limit detection sensor S10 as well as feed signals from the main unit H. Thereafter, the rise and fall operation of the support plate 22 executes.

Next, the document send operation of the automatic document feeding apparatus with the above composition will be described.

At first, the single-side mode that reads one side of the document will be described. When a feed signal (feed command) is received from the main unit H with the empty sensor S1 in an ON state, in other words, the sensor detects that a document is loaded on the feed tray, the support plate 22 is controlled to rise and fall until the document at the highest position makes contact with the supply roller 23.

The rise and fall control of the support plate will be described in detail afterward.

The feed motor M1 starts turning forward. This turning action turns the supply roller 23 and the feed roller 24 sending the documents on the feed tray. At this time, the supply roller 23 and the feed roller 24 are turned in the document send direction although the pair of resistance rollers 26 does not turn due to the function of the one-way clutch OW2. Then, when the resistance sensor S3 detects the leading edges of the documents being fed, the feed motor M1 is stopped once after the documents are transported by a predetermined amount from the moment the leading edge is detected. At this time, the leading edges of the documents are pushed against the nip portion of the pair of resistance rollers 26 and are formed into an arc shape. This aligns the leading edges of the documents and eliminates skewing. After the feed motor M1 stops once, it is driven in reverse and the documents are fed from the feed path 11 to the transport path 12.

The transport motor M2 is driven simultaneously with the reverse turning drive of the feed motor M1, resulting in the documents transported on the feed path 11 being transported along the transport roller 27. Then, when the leading edges of the documents transported in the transport path 12 are detected by the lead sensor S4, the documents are then transported by a predetermined amount and the feed motor M1 and the transport motor M2 are stopped. At this time, the documents stop at a position in front of the first contact glass 1*a*. Then, when the read/transport signal is received from the main unit H, the transport motor M2 drives again for allowing the documents to pass over the first contact glass 1*a*. While the documents pass over the glass, the front surfaces of the documents are read by the reading means.

Next, the send operation for the documents is selected depending on the subsequent document size.

When the documents are long, the first solenoid magnetizes and moves to a position for guiding the first flapper 40 to the first delivery tray 18 along with the first reverse delivery motor M3 driving in the forward direction for turning the pair of first delivery rollers 32 forward. This action discharges documents which have passed over the first contact glass 1*a* by means of the transport roller 27 to the first delivery tray 18 along the first delivery path 13 from the document feed.

When the documents are short, the first flapper 40 is held at its position where it is guided to the middle path 15 and the first reverse delivery motor M3 drives in the forward direction for turning the middle rollers 33. This action guides documents which have passed over the first contact glass 1*a* and discharges them to the second delivery tray 19 through the second delivery path 16 by means of the middle rollers 33 and the pair of second delivery rollers 35.

Next, the double-side mode in which both surfaces of the document are read will be described. In the double-side mode, the document feed and transport operation from the feed tray 10 to the position in front of the first contact glass 1*a* is controlled identical to the document feed and transport operation of the single-side mode.

When a read transport signal is received from the main unit H, the transport motor M2 and the first delivery motor M3 turn forward. By means of this action, the front surface of the document is read by the read means in a process in which the document passes over the first contact glass 1*a*. At this time, in the double-side mode, the first solenoid magnetizes and moves to a position for guiding the first flapper to the first delivery path 13 irregardless of the length of the document. The document whose front surface is read by this action is guided to the first delivery path 13.

The edge of the document guided to the first delivery path 13 presses upward on the third flapper 42 arranged such that the first delivery path 13 is blocked and is then transported to the delivery tray 18. Then, when the first delivery sensor S5 detects the trailing edge of the document, the first delivery motor M3 and the transport motor M2 are stopped. When they stop, the trailing edge of the document is nipped by the pair of delivery rollers 24 and the leading edge is exposed on the first delivery tray 18. Thereafter, the first delivery motor M3 is driven in reverse. This action turns the pair of first delivery rollers 32 in reverse for switching back the document and guiding it in the circulation path 14 along the document guiding surface of the third flapper 42.

The leading edge of the document switched back by the pair of first delivery rollers 32 is transported by a predetermined amount after being detected by the first delivery sensor S5. Because of this, the leading edge of the document is pushed against the nip portion of the transport roller 27 in a stopped state and the driven roller 28 that is pressing against the transport roller 27 for forming the leading edge into an arc shape. This eliminates skewing.

The transport motor M2 drives again to re-supply a document and the transport roller 27 is turned. The document is transported for following the transport roller 27, and when the leading edge of the document is detected by the lead sensor S4, the transport motor M2 stops after a predetermined time.

In other words, the document whose leading edge is sent to the first delivery tray 18 is returned to the transport path 12 again through the circulation path 14 by the first delivery rollers 32.

Then, when the read/transport signal is received from the main unit H, the transport motor M2 drives again and the first delivery motor M3 turns forward. Because of this, the rear surface of the document is read by the reading means in a process in which the document passes over the first contact glass 1*a*.

Hereupon, depending on the document size, there are different operations to control the first flapper 40, switch the path that guides the document and then finally discharge the document.

If the size of the document is long, the first flapper 40 moves to a position where the document is guided to the first delivery path 13. The document is then guided to the first delivery path 13 and is returned to the transport path 12 again through the circulation path 14 in order to line up the pages. Then, the document passes over the first contact glass 1*a* and is delivered to the delivery tray 18 from the first delivery path 13.

If the size of the document is short, the magnetization of the first flapper 40 is released. The flapper moves to a position for guiding the document to the middle path 15 and then the document is guided from the middle path 15 to the switchback path 17*a*. After the document is switched back by the switchback path 17*a*, it is reversed by the reverse path 17*b* and delivered to the second delivery tray 19.

The raise and lower mechanism and the rise and fall operation of the support plate 22 will be described now.

Figure 4A:
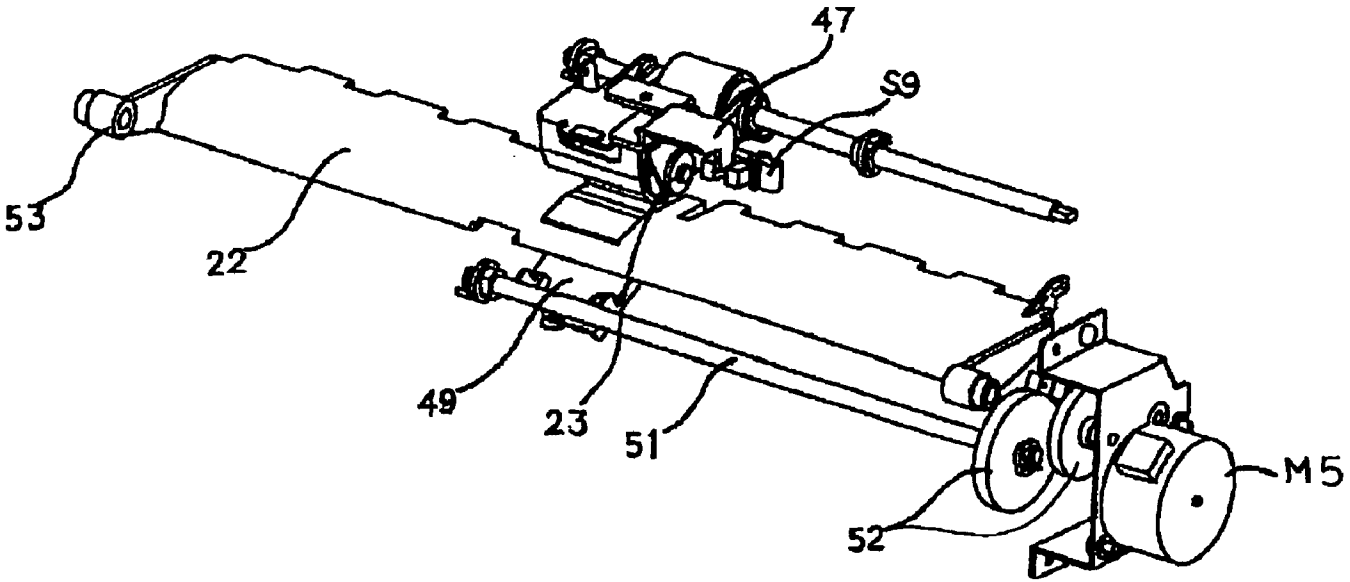
FIGS. 4(*a*) and 4(*b*) are views showing a raise and lower mechanism of a support plate according to the present invention.
Figure 4B:
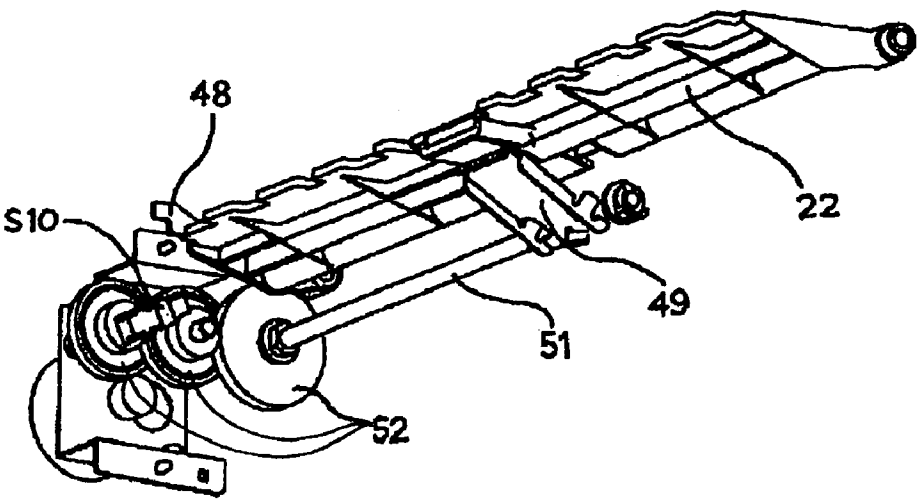

FIGS. 4(*a*) and 4(*b*) show the raise and lower mechanism that raises and lowers the support plate 22 in the document supply assembly of the apparatus. FIG. 4(*a*) is a perspective view looking at the control mechanism from the top and FIG. 4(*b*) is a compositional example looking at the control mechanism from the bottom.

The control mechanism of the support plate 22 in this embodiment is comprised by the support plate 22 that loads, raises and lowers documents, the rotating support point shaft 53 that is mounted to the apparatus frame and functions to rotate, and raise and lower the support plate 22, the rise and fall lever 48 that makes contact with the lower edge of the surface of the support plate 22 in the document transport direction and raises and lowers the support plate 22, the rotating shaft 51 that is coupled to the rise and fall lever 48 and allows the rise and fall lever 48 to rotate, the rise and fall motor M5 that can rotate forward and allows the rotating shaft 51 to rotate, and the plurality of gears 52 which transfer the driving force of the rise and fall motor M5 to the rotating shaft 51.

According to this composition, when the rise and fall motor M5 turns forward, the support plate 22 transfers the driving force of the motor to the rotating shaft 51 by way of the plurality of gears 52, thereby turning the rotating shaft 51 upward. Then, the turning of the action of the rotating shaft 51 turns the rise and fall lever 48 which makes contact with the lower surface of the support plate 22. The lever presses against the support plate 22 for raising it upward.

When the rise and fall motor M5 turns in reverse, the rotating shaft 51 turns downward by way of the gears 52. This action lowers the rise and fall lever 48 for releasing the support of the rise and fall lever 48 and allowing the support plate 22 to fall by its own weight.

This raise and lower mechanism is equipped with the lower limit detection means that detects whether the support plate 22 is located at a position where the document can be loaded, and an upper limit detection means that detects whether the document at the highest position on the support plate 22 is making contact with the supply roller 23.

The lower limit detection means has the lower limit sensor lever 48 coupled to the support lever 22, the light emitting assembly, and the light receiving assembly. The lower limit detection means is comprised by the concave lower limit sensor S10 formed such that it blocks light from the light emitting assembly to the light receiving assembly by means of the lower limit sensor lever 48 entering into it. The upper limit detection means has the upper limit sensor lever 47 formed on the bracket of the supply roller 23, the light emitting assembly, and the light receiving assembly. The upper limit detection means is comprised by the concave upper limit sensor S9 formed such that it blocks light from the light emitting assembly to the light receiving assembly by means of the upper limit sensor lever 48 entering into it.

The rise and fall motor M5 is controlled by means of the detection results of this lower limit detection means and upper limit detection means for raising and lowering the support plate 22 to the upper limit position and the lower limit position.

The upper limit position of the support plate 22 mentioned above is a position where the surface of the document at the highest position on the support plate 22 makes contact with the supply roller 23. In addition, the upper limit position of the support plate 22 is a position that changes depending on the amount of documents loaded. The lower limit position of the support plate 22 is a position where documents can be loaded onto the support plate 22.

Figure 5:
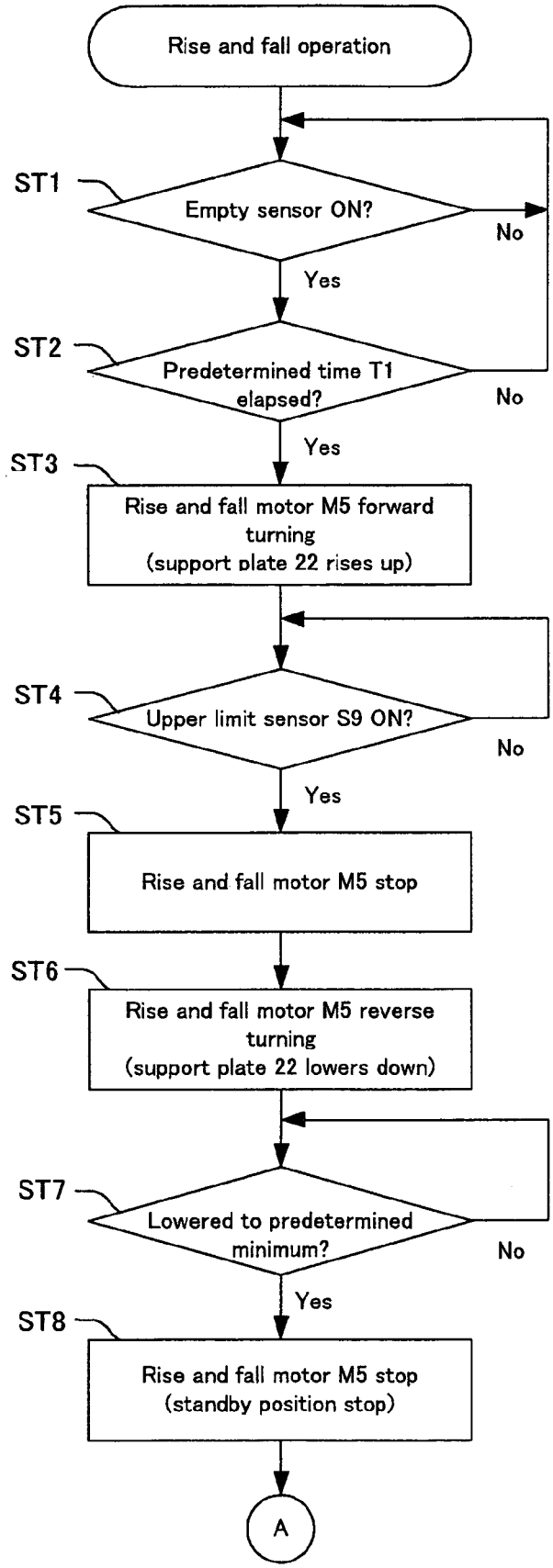
FIG. 5 is a flowchart showing a rise and fall operation of the support plate according to the present invention.
Figure 6:
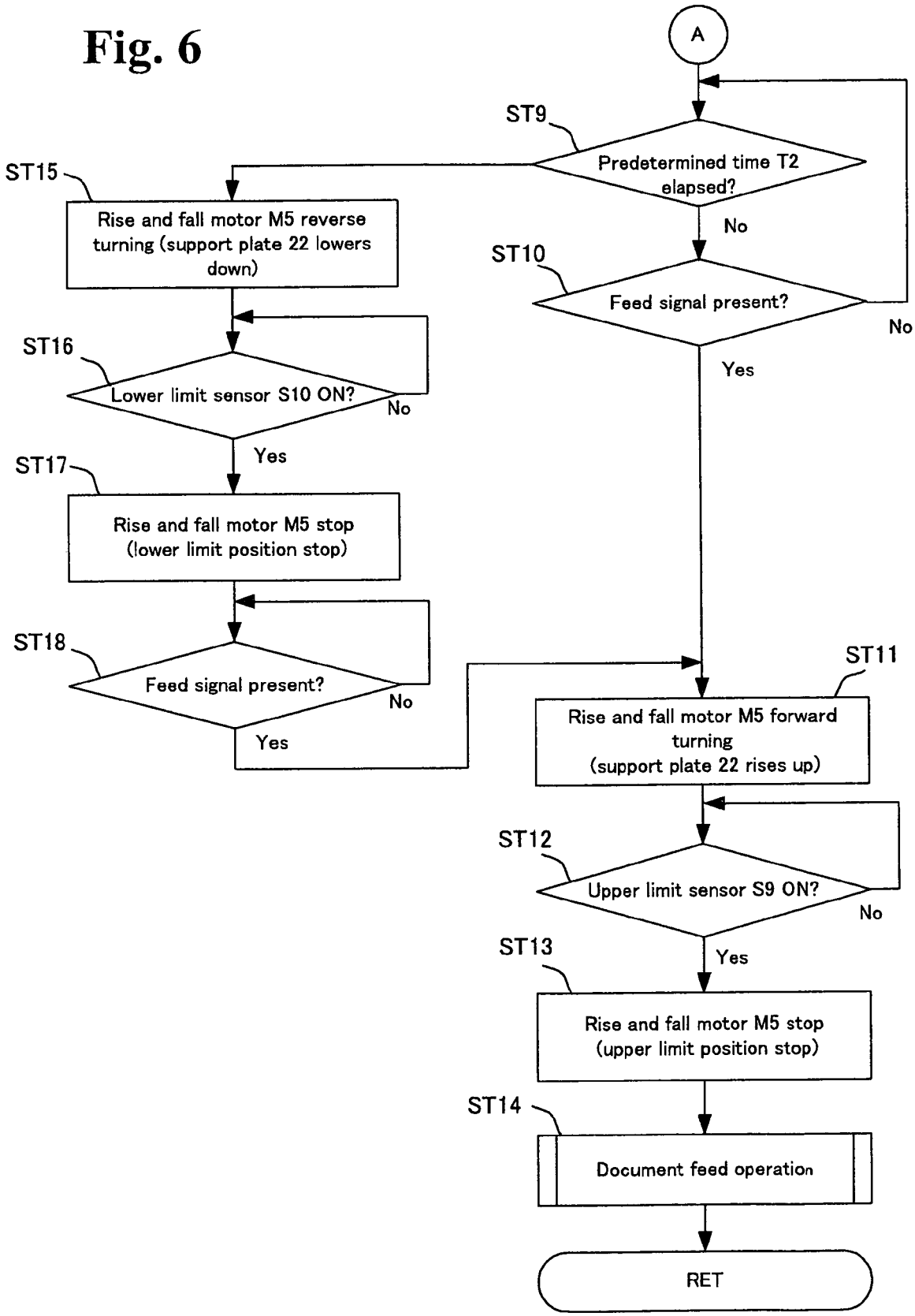
FIG. 6 is a flowchart showing the rise and fall operation of the support plate according to the present invention.

Next, the rise and fall operation of the support plate 22 will be described based on the control block diagram shown in FIG. 3, the rise and fall control flowchart of the support plate 22 shown in FIG. 5 to FIG. 6 and the state diagrams shown in FIG. 7 to FIG. 10.

Figure 7:
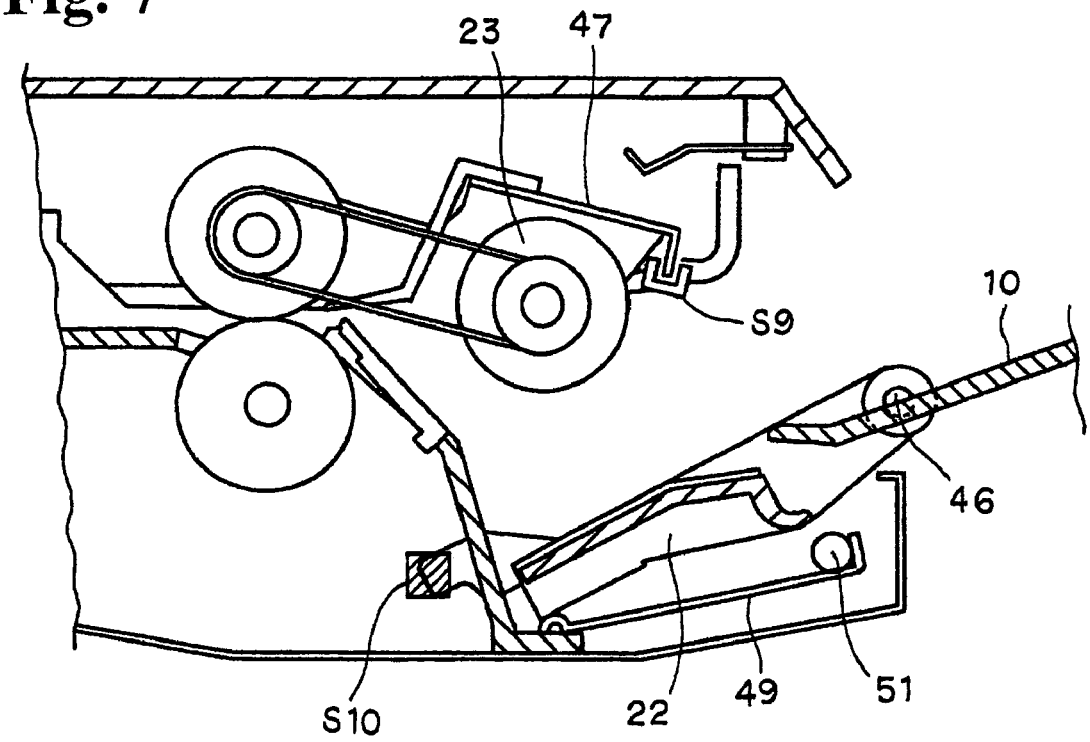
FIG. 7 is a view showing a state in which the support plate according to the present invention is located at a lower limit position.

As shown in FIG. 7, when the document is loaded onto the feed tray 10 and the support plate 22 while the support plate 22 is located at the lower limit position, the loaded document will be detected by the empty sensor S1 (ST1). The rise and fall motor M5 turns forward (ST3) after a predetermined time T1 passes (ST2) from the time when the empty sensor S1 detects the document. This action raises the rise and fall plate 22.

Here, the predetermined time T1 is a time required for the operator to load the document at a suitable position. This eliminates the support plate 22 from rising up suddenly while stacking document as well as making it possible to securely stack documents at a suitable position on the feed tray thereby eliminating any apprehension operators may have.

Figure 8:
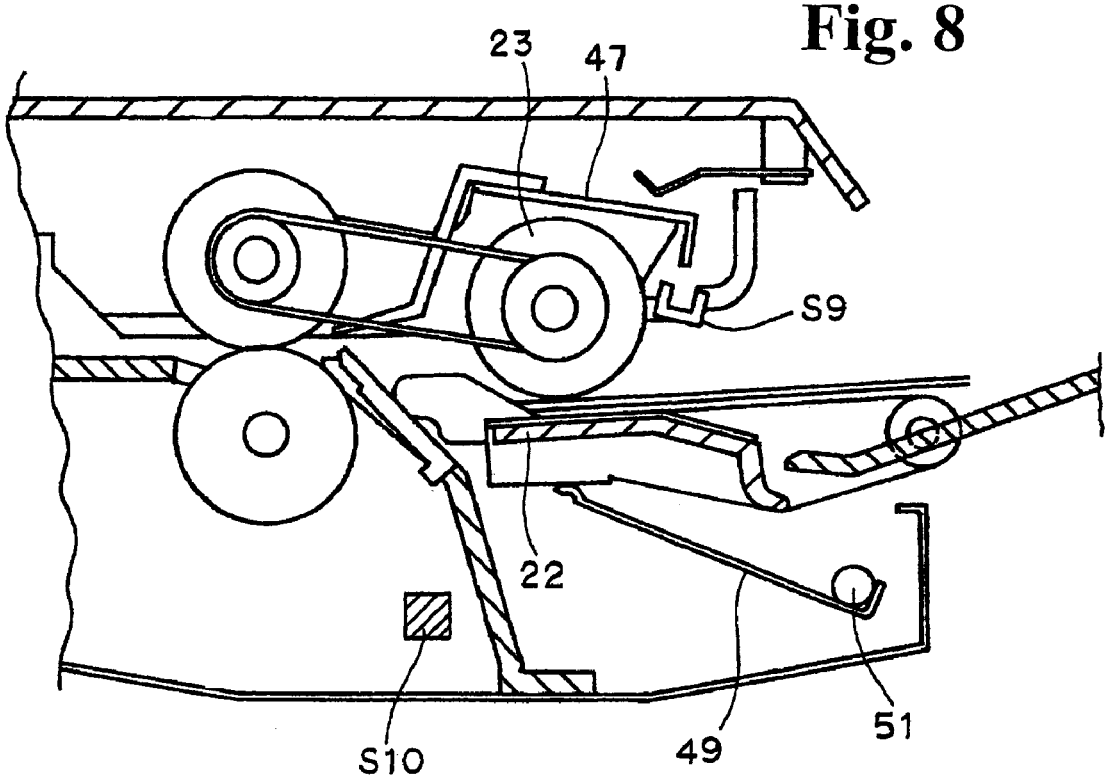
FIG. 8 is a view showing a state in which the support plate according to the present invention is located at an upper limit position.

The surface of the document at the highest position makes contact with the supply roller 23, as shown in FIG. 8, by means of the rising support plate 22 gradually raising up the documents. The upper limit sensor will turn ON when the surface of the document at the highest position rises up to the position where it makes contact with the supply roller 23 (ST4). The support plate 22 reaching the upper limit position is detected by this.

Figure 9:
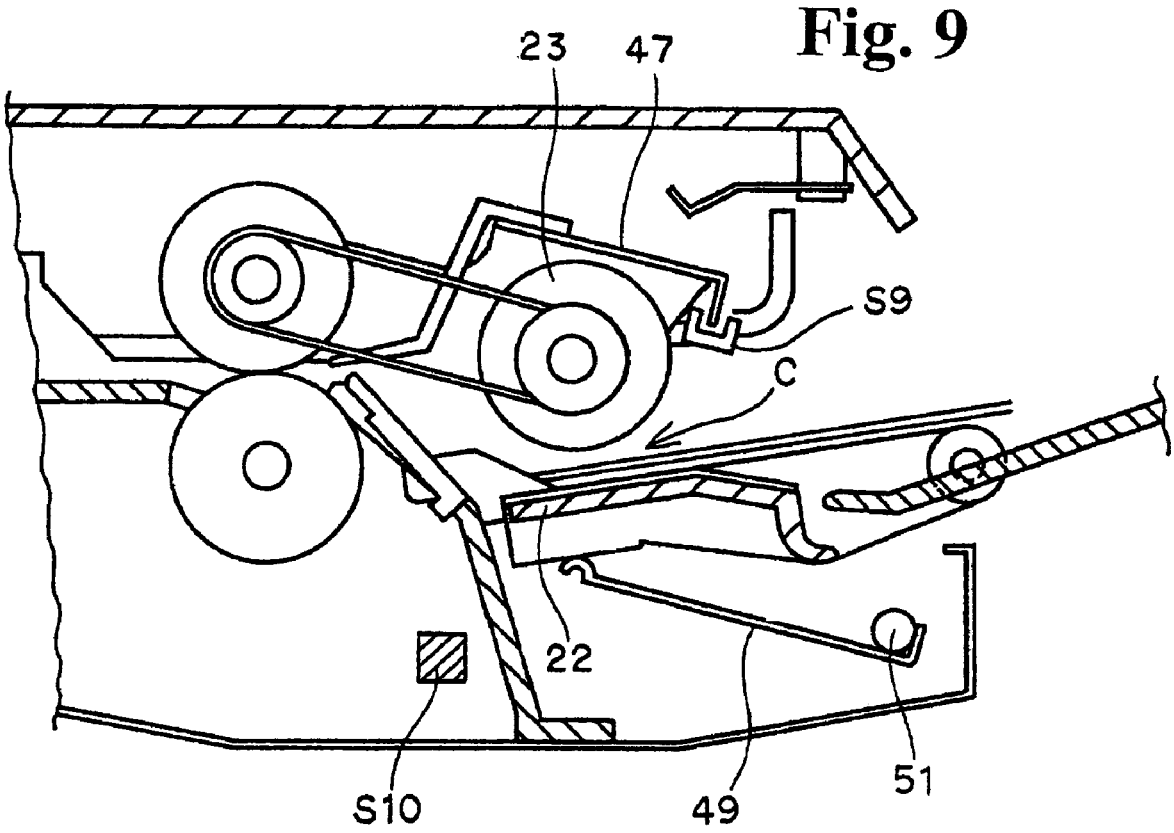
FIG. 9 is a view showing a state in which the support plate according to the present invention is located at a standby position.

When the upper limit sensor S9 detects that the support plate 22 has reached the upper limit position, the rise and fall motor M5 will stop once (ST5). Thereafter, the rise and fall motor M5 turns in reverse and the support plate 22 is lowered by a predetermined amount L and stops (ST6 to ST8). At this time, the support plate 22 is in a standby state lowered by only a predetermined amount C as shown in FIG. 9.

Hereupon, the above-mentioned predetermined amount C is an amount determined in advance that lowers the surface of the document at the highest position to a position where it does not make contact with the supply roller 23.

Because the support plate 22 lowers the surface of the document at the highest position to a position where it does not make contact with the supply roller 23 and waits in a standby state in this manner, the operator can easily remove documents from the feed tray 10 without affecting the supply roller 23.

When the feed signal is received from the main unit H within the predetermined time T2 after the support plate 22 is lowered to the standby position, the rise and fall motor M5 will turn forward again and the support plate 22 will rise up from the standby position (ST9 to ST11). In addition, when the upper limit sensor S9 detects that the rising support plate has reached the upper limit position, the rise and fall motor M5 will stop (ST12 to ST13). At this time, the surface of the document at the highest position is brought into contact with the supply roller 23 as shown in FIG. 8.

Thereafter, the feed motor M1 turns forward driving the feed roller 24 and supplying documents. Subsequently, the document feed operation described above is executed (ST14).

When the feed signal is received from the main unit H within the predetermined time T2 after the support plate 22 is lowered to the standby position, the rise and fall motor will turn in reverse again and the support plate 22 will lower down (ST9, ST15). When the lower limit sensor S10 detects that the support plate 22, lowering down from the standby position, has reached the lower limit position, the rise and fall motor M5 will stop (ST16 to ST17). Thereafter, when the feed signal is received from the main unit H (ST18), the normal document feed operation will execute (ST11 to ST14), wherein the rise and fall motor M5 immediately turns forward for raising the support plate 22 from the lower limit position to the upper limit position and driving the supply roller 23 and the feed roller 24.

Figure 10:
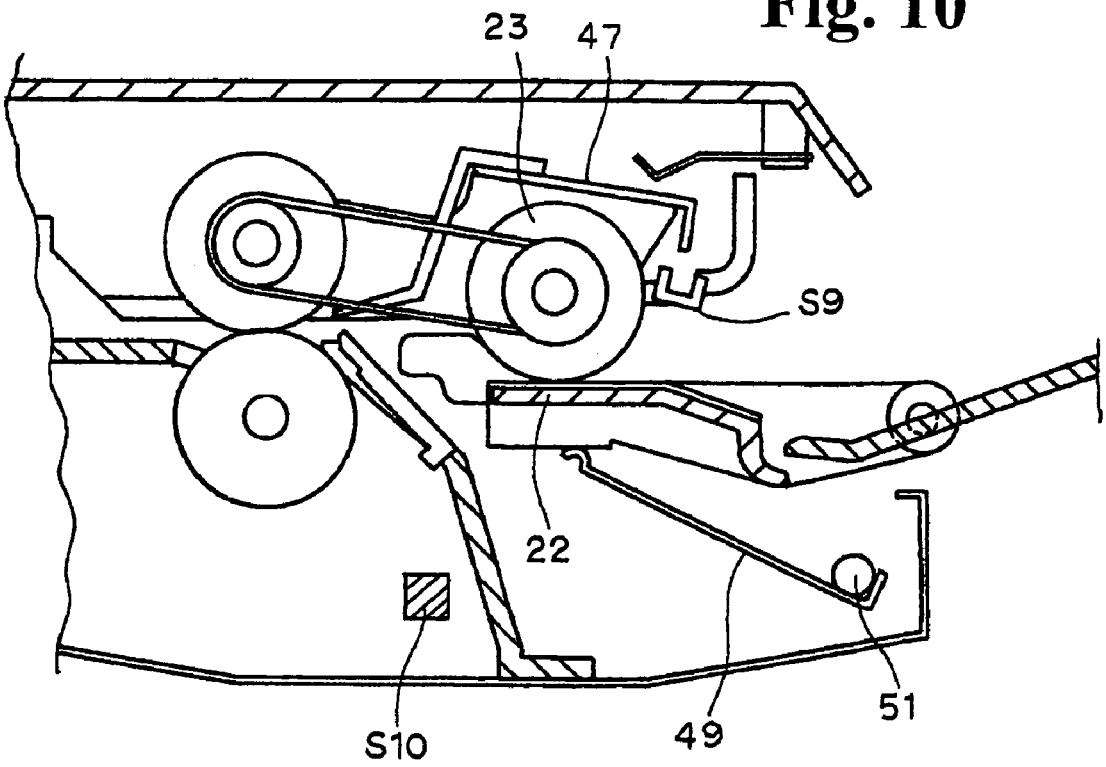
FIG. 10 is a view showing a state in which the document on the support plate according to the present invention is fed completely.

Then, as shown in FIG. 10, all the documents on the feed tray 10 are fed by means of the document feed operation. When the empty sensor S1 detects that there are no more documents on the feed tray, the rise and fall motor M5 immediately turns in reverse and the support plate 22 is controlled lowering down to the lower limit position.

When the feed signal is received from the main unit H within the predetermined time T2 with the support plate 22 at the standby position in this manner, the fact that the support plate 22 is lowered down to the lower limit position makes it possible to reduce the electrical power consumption because it is not necessary to supply a holding current to the rise and fall motor M5.

Furthermore, the support plate 22 is controlled so as to be forcefully raised up to the upper limit position where the document feed operation executes when the feed signal is received during the above-mentioned rise and fall operation.

Even further, the support plate 22 is controlled so as to immediately lower down to the lower limit position when the empty sensor S1 detects that there are no documents due to, for example, the documents being removed.

Describing the above-mentioned embodiment in more detail, when the empty sensor S1 detects a document before the feed signal from the main unit H is received, the support plate 22 will rise up to the standby position in advance and then rise from the standby position up to the upper limit position in order to supply the documents at the moment when the feed signal is received from the main unit H. Consequently, it is possible to greatly shorten the time until the document at the highest position is supplied irregardless of the amount of documents loaded on the feed tray.

In the above-mentioned embodiment, control is such that when the rise and fall support plate 22 to the standby position is moved, it rises until it is detected once by the upper limit sensor S9. Thereafter, the rise and fall support plate 22 lowers down by a predetermined amount, and the standby position is made a position as close as possible to the supply roller. However, after taking into consideration the maximum amount of document that can be loaded, it is also possible to arrange the sensor at a suitable position between the lower limit position and the upper limit position and then use the sensor to detect and wait for the support plate 22.

Next, a modified example of the rise and fall control of the support plate 22 will be described below.

Figure 11:
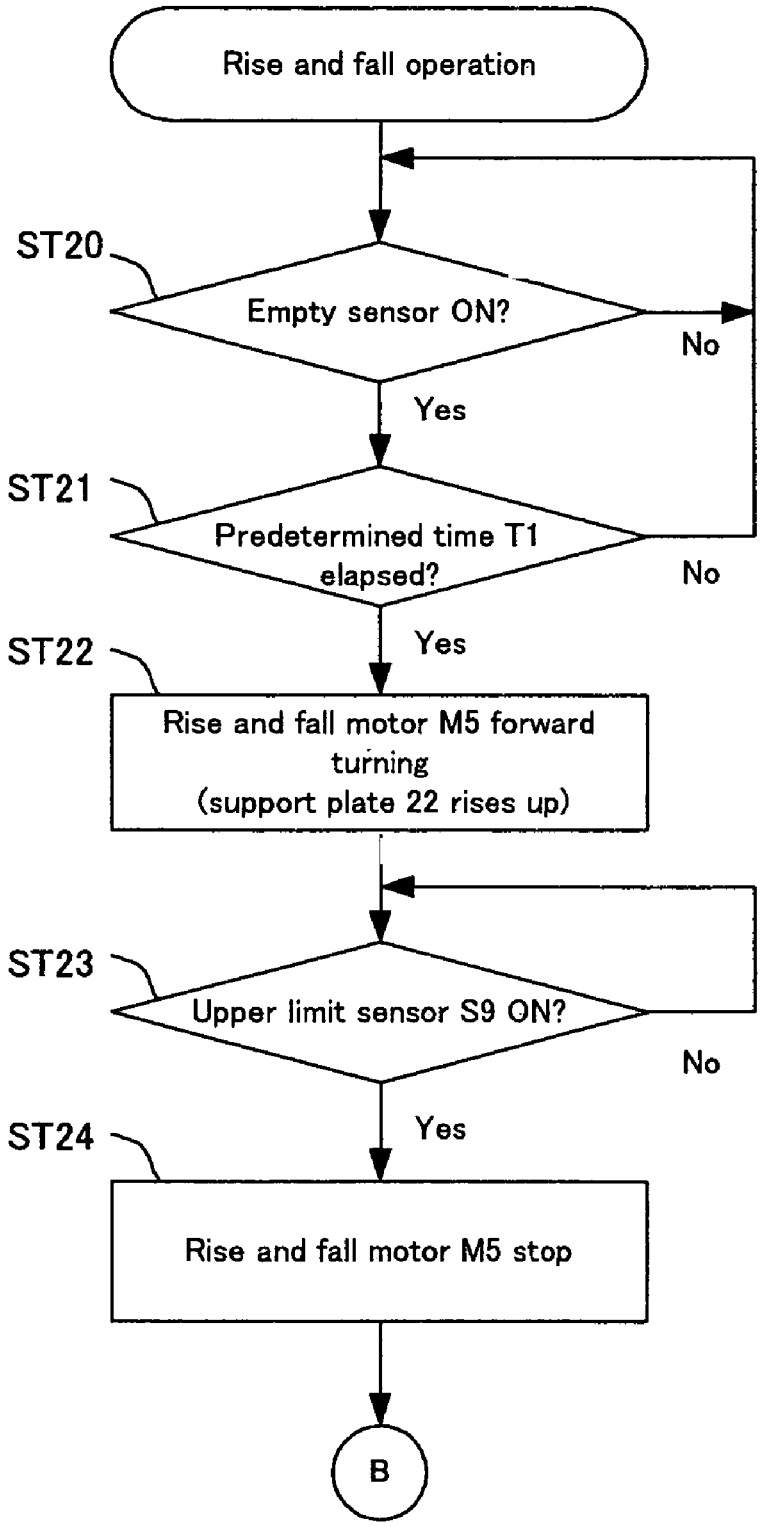
FIG. 11 is a flowchart showing the rise and fall operation of the support plate in a modified example according to the present invention.
Figure 12:
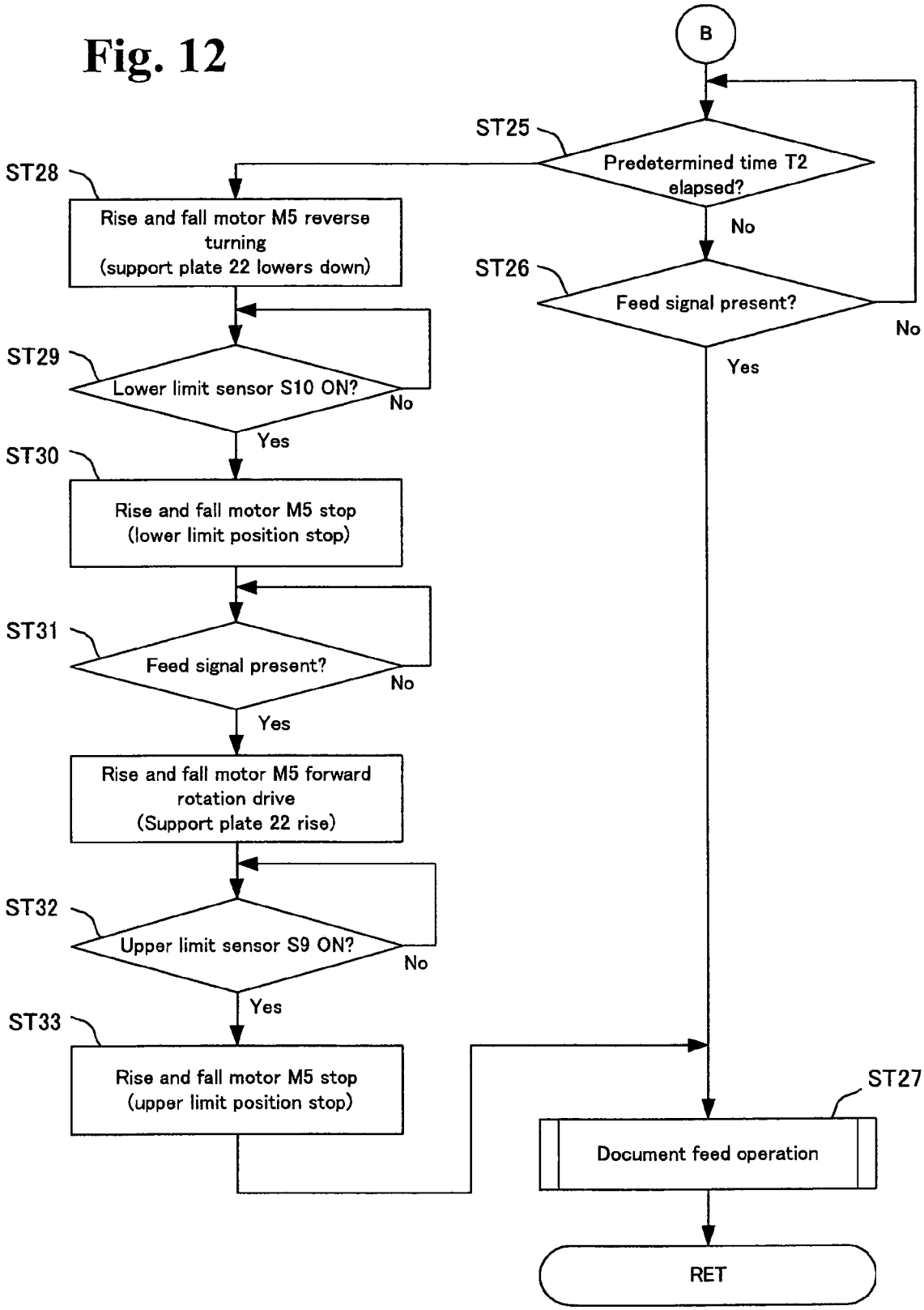
FIG. 12 is a flowchart showing the rise and fall operation of the support plate in a modified example according to the present invention.

In the above-mentioned embodiment, if we take into consideration removing the documents from the feed tray 10 after stacking them one time on the feed tray 10, setting the standby position and removing the documents are easier. In this modified example, however, as shown in the rise and fall control flowchart of FIG. 10 to FIG. 11, control is such that the document detection performed by the empty sensor S1 allows the support plate 22 to be raised from the lower limit position, where the documents are loaded, up to the upper limit position in order to supply the documents (ST20 to ST24) thereafter driving the supply roller at the moment when the feed signal is received from the main unit H. This makes it possible to shorten the time even more than the document supply time in the above-mentioned embodiment.

In addition, in the rise and fall operation of the modified example, control is such that when the feed signal is not received even though the predetermined time has elapsed after the support plate rises from the lower limit position to the upper limit position in order to supply the documents, the support plate will lower and return to the lower limit position (ST25 to ST30). Because of this, an effect can be obtained that makes it possible to reduce the electrical power consumption in like manner to the above-mentioned embodiment.

While the present invention has been explained with reference to the specific embodiments of the invention, the explanation is illustrative and the invention is limited only by the appended claims.

What is claimed is:

1. A method of controlling a sheet feeder apparatus for sequentially feeding sheets to a predetermined processing position, comprising, receiving a detection signal of a sheet when the sheet is placed on a rise and lower tray located at a lower limit position before receiving a feed signal to start feeding of the sheet, moving the rise and lower tray from the lower limit position to a standby position above the lower limit position and below an upper limit position to standby upon receiving the detection signal, and moving the rise and lower tray to the lower limit position when there is no feed signal for a predetermined time after the rise and lower tray moves to the standby position.

* * * * *